US007584770B2

(12) United States Patent
Anderson et al.

(10) Patent No.: US 7,584,770 B2
(45) Date of Patent: Sep. 8, 2009

(54) INTEGRATED PRODUCT FILLER

(75) Inventors: Glenn Anderson, Pocatello, ID (US); Stephen Howard, Pocatello, ID (US)

(73) Assignee: Stainless Specialists, Inc., Wausau, WI (US)

( * ) Notice: Subject to any disclaimer, the term of this patent is extended or adjusted under 35 U.S.C. 154(b) by 131 days.

(21) Appl. No.: 11/668,965

(22) Filed: Jan. 30, 2007

(65) Prior Publication Data

US 2007/0175540 A1 Aug. 2, 2007

Related U.S. Application Data

(60) Provisional application No. 60/763,216, filed on Jan. 30, 2006.

(51) Int. Cl.
*B65B 1/04* (2006.01)
*B65B 3/04* (2006.01)
*B67C 3/02* (2006.01)

(52) U.S. Cl. ..... 141/5; 141/163; 141/255; 53/473; 222/233

(58) Field of Classification Search ..... 141/1, 141/5, 129, 163, 255; 222/1, 233, 372, 380, 222/409, 410; 53/473
See application file for complete search history.

(56) References Cited

U.S. PATENT DOCUMENTS 4,402,428 A * 9/1983 Lang et al. ..... 222/58
4,451,954 A * 6/1984 Muller et al. ..... 222/18
4,693,397 A * 9/1987 Lang ..... 222/137
4,842,162 A * 6/1989 Merkel ..... 222/1
4,993,598 A * 2/1991 Groninger ..... 222/148
5,108,014 A * 4/1992 Nordmeyer et al. ..... 222/380
5,431,198 A * 7/1995 Turtchan et al. ..... 141/258
6,484,745 B1 * 11/2002 Navarro ..... 137/312
7,357,280 B2 * 4/2008 Nishinomiya et al. ..... 222/252
2004/0237472 A1 * 12/2004 De Cardenas et al. ..... 53/399
2006/0081305 A1 * 4/2006 Monti ..... 141/144

* cited by examiner

*Primary Examiner*—Timothy L Maust
*Assistant Examiner*—Nicolas A Arnett
(74) *Attorney, Agent, or Firm*—Ziolkowski Patent Solutions Group, SC

(57) ABSTRACT

An integrated filler system to transfer a filler product from a filler product source to a product receptacle is provided. The integrated filler system includes a cylinder housing, a pallet valve disposed within the cylinder housing that contains a product flow aperture, and a piston inserted in a valve bore of the pallet valve. A linear actuator is connected to the piston to selectively actuate a linear travel of the piston within the valve bore. A rotary actuator is connected to the pallet valve to selectively position the product flow aperture to fluidly communicate with either a product input port or a product output port formed in the cylinder housing.

23 Claims, 4 Drawing Sheets

INTEGRATED PRODUCT FILLER

CROSS-REFERENCE TO RELATED APPLICATION

The present application claims priority to U.S. Provisional Patent Application Ser. No. 60/763,216 filed Jan. 30, 2006, the disclosure of which is incorporated herein by reference.

BACKGROUND OF THE INVENTION

The present invention relates generally to automated dispensing devices and, more particularly, to an apparatus for dispensing viscous products in production settings.

Automated fillers for dispensing viscous food product in production settings have evolved to a state wherein several devices connected in series provide the requisite functions of storage and measured dispensation of the viscous food product. In meeting these functions, conventional automated fillers often employ a viscous food product storage, a device for withdrawal of the viscous food product from the viscous food product storage, a mechanism for transferring the viscous food product from the storage device for withdrawal of the viscous food product from the viscous food product storage to a dispensing apparatus, a dispensing valve and a tube attached at one end to the dispensing valve and a second end positioned at a point of discharge.

While such conventional fillers provide for the automated dispensing of viscous food product, improvements may be realized over current designs and arrangements. For instance, given the number of discreet components or parts currently employed to accomplish the filling process, trouble shooting, adjustment and timing of the various components may be difficult and time consuming. Additionally, because the actuators of conventional fillers are often of analog design, the range and operating parameters of the fillers are typically limited.

BRIEF DESCRIPTION OF THE INVENTION

The above-mentioned limitations associated with conventional automated fillers are addressed by embodiments of the present invention and will be understood by reading and studying the following specification.

According to one aspect of the present invention, an integrated filler system to transfer a filler product from a filler product source to a product receptacle includes a cylinder housing and a pallet valve disposed within the cylinder housing, the pallet valve including a product flow aperture. The integrated filler system also includes a piston inserted in a valve bore of the pallet valve, a linear actuator connected to the piston to selectively actuate a linear travel of the piston within the valve bore. The integrated filler system further includes a rotary actuator connected to the pallet valve to selectively position the product flow aperture to fluidly communicate with one of a product input port and a product output port formed in the cylinder housing.

In accordance with another aspect of the present invention, a servo controlled integrated filler system includes a cylinder housing having a cylinder bore therein, a product input port, and a product output port. The servo controlled integrated filler system also includes a pallet valve disposed within the cylinder bore containing at least one product flow aperture therein and a piston positioned in a valve bore of the pallet valve. The servo controlled integrated filler system further includes a first actuator connected to the piston to actuate a first movement thereof, a second actuator connected to the pallet valve to selectively position the at least one product flow aperture to align with one of the product input port and the product output port, and a servo controller system to control movement of at least one of the first actuator and the second actuator.

In accordance with yet another aspect of the present invention, a method for transferring a filler product from a filler product source to a product receptacle includes the step of connecting an integrated filler system to a filler product source, the integrated filler system including a pallet valve disposed within a cylinder bore of a cylinder housing, and wherein the cylinder housing includes a product input port and a product output port selectively fluidly connected to the cylinder bore. The method also includes the steps of aligning a product flow aperture of the pallet valve with the product input port to place a valve bore in the pallet valve in fluid communication with the filler product source and displacing a piston to draw a filler product from the filler product source. The method further includes the steps of aligning the product flow aperture with the product output port; and displacing the piston to discharge the filler product through the product flow aperture and the product output port.

Additional advantages and novel features will be set forth in part in the description that follows, and in part will become apparent to those skilled in the art upon examination of the following, or may be learned by practice of embodiments of the invention. Additionally, advantages may be realized and attained by means of the instrumentalities and combinations particularly pointed out in the appended claims.

BRIEF DESCRIPTION OF THE DRAWINGS

Like reference numbers and designations in the various drawings indicate like elements.

DETAILED DESCRIPTION OF THE INVENTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical, and electrical changes may be made without departing from the spirit and scope of the present invention. The following detailed description is, therefore, not to be taken in a limiting sense.

Figure 1:
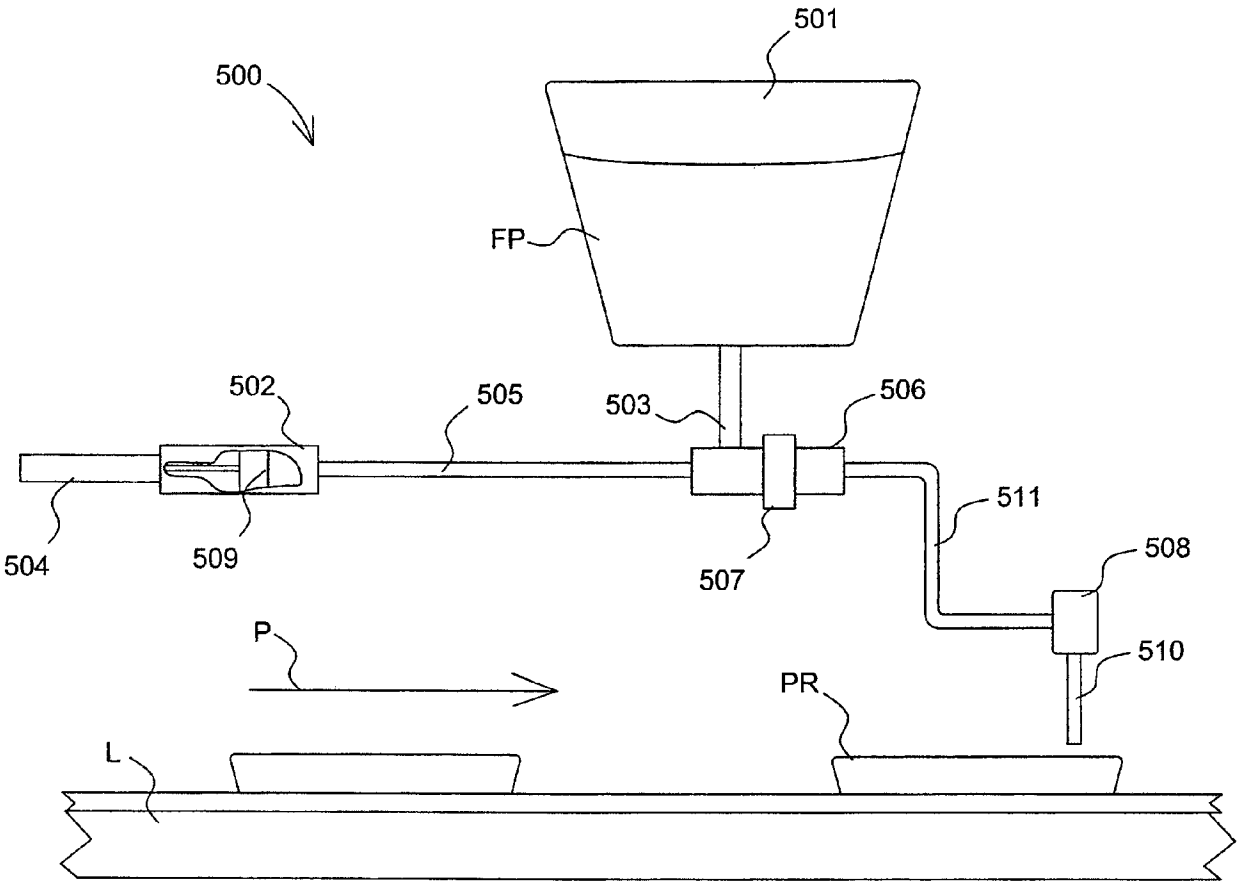
Fig. 1 (Prior Art)
FIG. 1 is a schematic representation of a conventional filler system.

FIG. 1 depicts schematically a conventional filler system 500 that includes viscous food product storage 501 and product cylinder 502 including piston 509 actuated in a reciprocating fashion by actuator 504. In operation, piston 509 can be displaced by actuator 504, thereby withdrawing viscous food product FP from the viscous food product storage 501 through conduit 503 and pallet valve 506 into the body of product cylinder 502. Upon return of piston 509 by actuator 504, viscous food product FP is forced through conduit 505 into pallet valve 506. Pallet valve 506 includes valve position actuator 507. Pallet valve 506 operates as a two position valve, a first position that permits viscous food product FP to pass from conduit 503, through conduit 505 into product cylinder 502, and a second position which permits passage of viscous food product FP from product cylinder 502 through conduits 505 and 511 to dispense valve 508. When dispense cylinder actuator 508 and product cylinder actuator 504 are actuated, viscous food product FP is transferred through pallet valve 506 into dispense conduit 510 to be discharged as product receptacle PR passes under dispense conduit 510 on production line L. As shown, product receptacles PR proceed in a process direction P on production line L.

Figure 2:
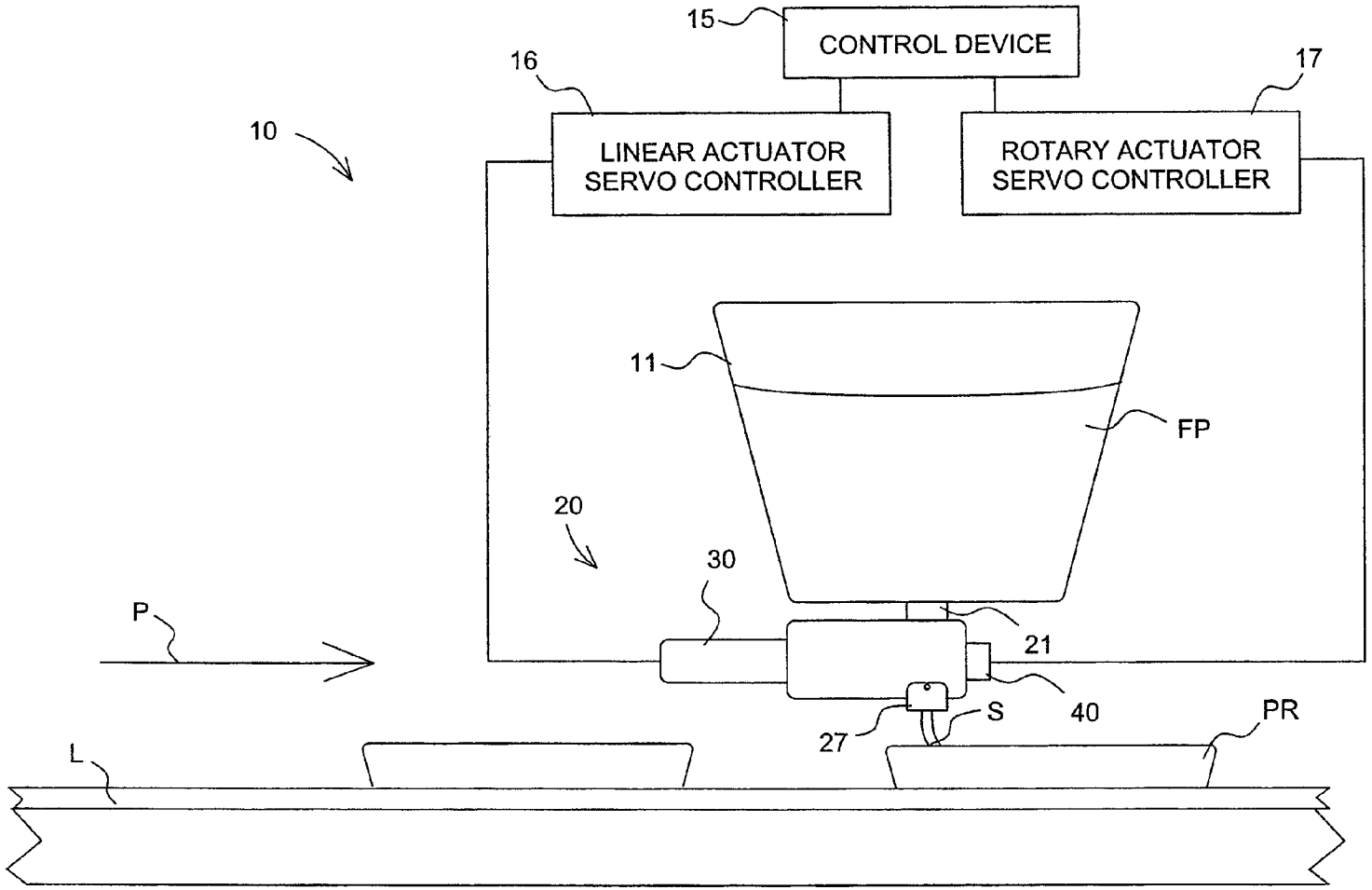
FIG. 2 is a schematic representation of a filler system according to one embodiment of the present application.

Referring to FIG. 2, filler system 10 includes filler product source 11 containing filler product FP. In some embodiments, filler product FP comprises viscous food product, such as, for example, sauce, gravy, liquid, etc. In other embodiments, filler product FP comprises any suitable viscous product dispensed in a production setting. For purposes of illustration in this disclosure, filler system 10 will be described primarily with reference to a food production environment in which filler product FP comprises viscous food product.

In the embodiment illustrated in FIG. 2, filler product source 11 is connected to integrated filler 20 at product input port 21. As shown, filler product FP is discharged from integrated filler 20 at nozzle 27. As product receptacle PR proceeds in process direction P on production line L, stream S of transferring filler product FP is dispensed from integrated filler 20 into product receptacle PR as it passes under nozzle 27 positioned above production line L. Linear actuator servo controller 16 is shown connected to linear actuator 30. Linear actuator servo controller 16 is adapted to control a stroke speed and a stroke length of linear actuator 30 as discussed herein below. Rotary actuator servo controller 17 is shown connected to rotary actuator 40 and is adapted to control an angular speed and an angular displacement of the rotary actuator 40, also discussed herein below. Control device 15 is connected to linear actuator servo controller 16 and rotary actuator servo controller 17 and is adapted for the programmable control and adjustment of linear actuator servo controller 16 and rotary actuator servo controller 17.

In a preferred embodiment, programmable control and adjustment of linear actuator servo controller 16 and rotary actuator servo controller 17 may be accomplished in real time, permitting "on the fly" adjustment of filling parameters. In one preferred embodiment, linear actuator servo controller 16 and rotary actuator servo controller 17 comprise pneumatic servo controlled motors, such as, for example, the LS-V series linear servo controlled motors manufactured by Enfield Technologies of Trumbull, Conn., USA. Control device 15 may comprise a system controller, such as, for example, the LS-C Series Pneumatic Device Controller also manufactured by Enfield Technologies of Trumbull, Conn., USA.

Figure 3:
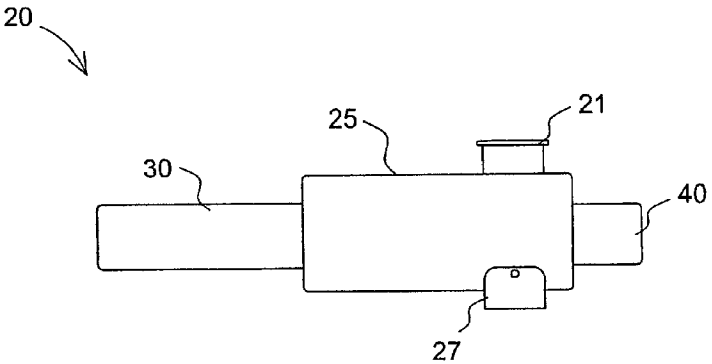
FIG. 3 is a representative perspective view of an integrated filler according to one embodiment of the present application.

Referring to FIG. 3, one exemplary embodiment of integrated filler 20 is shown including cylinder housing 25 having product input port 21 and nozzle 27. FIG. 3 also shows integrated filler 20 including linear actuator 30 and rotary actuator 40.

Figure 4:
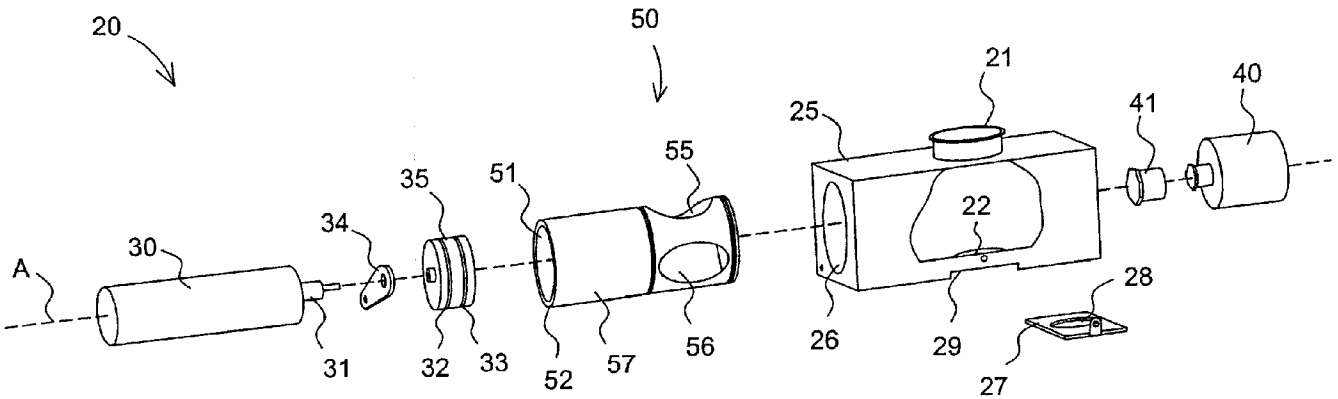
FIG. 4 is a representative perspective partially exploded view of an integrated filler according to one embodiment of the present application.

Referring to FIG. 4, one exemplary embodiment of integrated filler 20 is shown in a partially exploded view. Integrated filler 20 is shown including cylinder housing 25 having product input port 21 and nozzle 27. Cylinder housing 25 is shown in a partial cutaway showing product output port 22. Both product input port 21 and product output port 22 fluidly communicate with cylinder bore 26 of cylinder housing 25. As seen, cylinder bore 26 is formed along longitudinal axis A. Nozzle 27 is adapted for interchangeable fit in recess 29 of cylinder housing 25. In the illustrated embodiment, nozzle 27 includes discharge aperture 28.

Integrated filler 20 also includes linear actuator 30 and rotary actuator 40, as well as pallet valve 50 including a substantially cylindrical segment 52 adapted for sliding fit within cylinder bore 26. Linear actuator 30 attaches to cylinder housing 25 employing cylinder mount 34. Linear actuator 30 includes a selectively extendible and retractable rod 31, which attaches to piston 35. Piston 35 is adapted for sliding or reciprocating excursion within valve bore 51 of pallet valve 50. In the illustrated embodiment, piston 35 includes a pair of seals 32 and 33 for providing a leak-proof sliding fit within valve bore 51 of pallet valve 50.

Cylindrical segment 52 of pallet valve 50 is concentrically aligned with longitudinal axis A of cylinder bore 26. Cylindrical segment 52 is further adapted for rotational movement within cylinder bore 26 about longitudinal axis A. As shown, sidewall 57 defines cylindrical segment 52 which includes valve bore 51 formed along longitudinal axis A. Pallet valve 50 includes product intake aperture 55 and product discharge aperture 56 formed through sidewall 57 of cylindrical segment 52. In the illustrated embodiment, product intake aperture 55 is adapted for selective alignment with product input port 21 upon operation of rotary actuator 40. Similarly, product discharge aperture 56 is adapted for selective alignment with product output port 22 upon operation of rotary actuator 40. Rotary actuator 40 attaches to pallet valve 50 via drive shaft 41 that extends through a drive port (not shown), which is coextensive to cylinder bore 26.

In a use environment, integrated filler 20 may take on a variety of configurations or embodiments. For instance, integrated filler 20 may be positioned in a housing or attached to peripheral or related devices or equipment. As another example, rotary actuator 40 may be configured as a direct drive or a 90° drive, and may be connected to cylindrical segment 52 employing a variety of drive configurations. Additionally, cylindrical segment 52 may include one or more product flow apertures as preferred by design or application.

Figure 5:
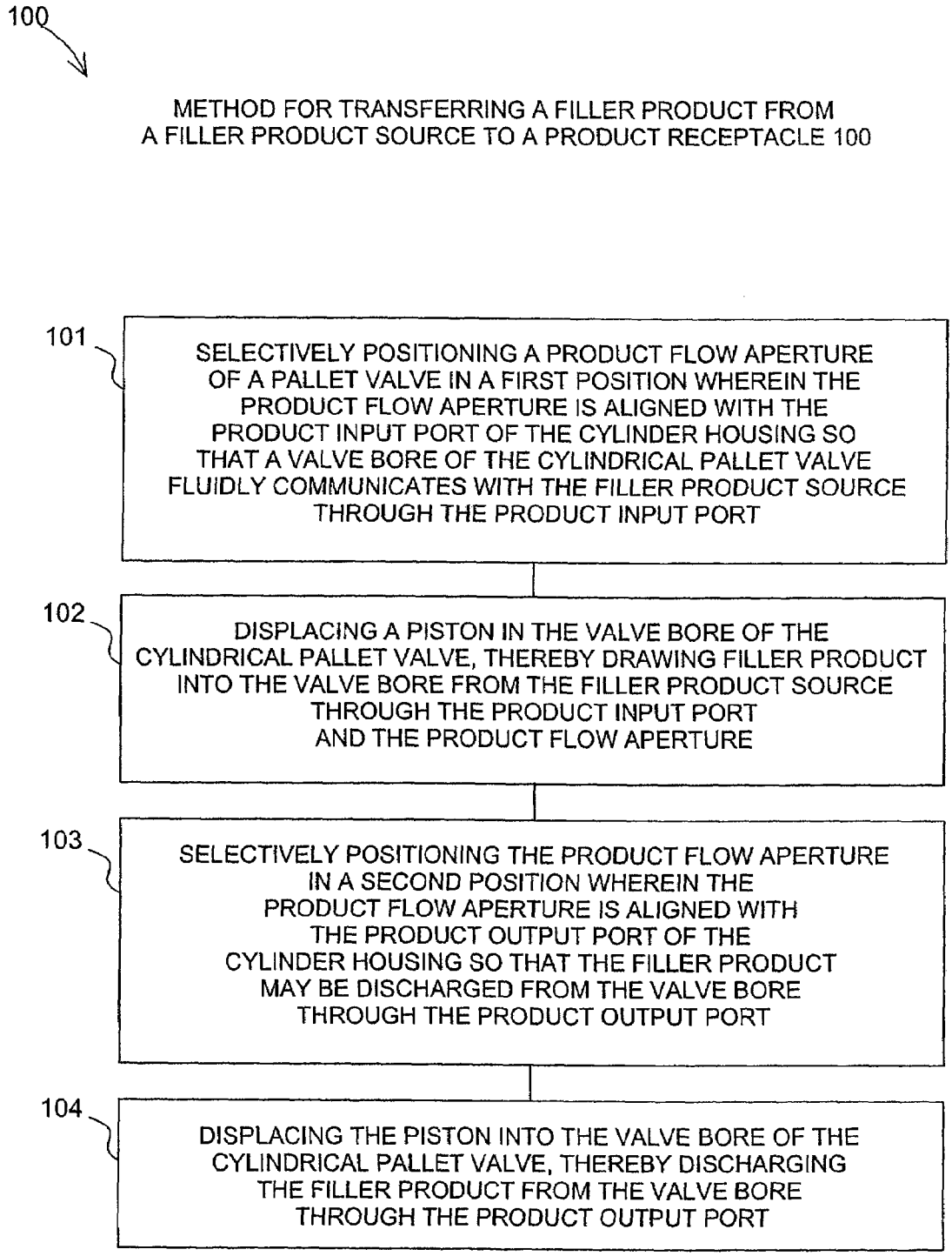
FIG. 5 is a schematic flow chart representing the steps of a method for transferring a filler product from a source to a receptacle.

FIG. 5 is a flow chart illustrating a method 100 for transferring a filler product from a filler product source to a product receptacle. In some embodiments, the method 100 employs an integrated filler system including a cylindrical pallet valve disposed within a cylinder bore of a cylinder housing, the cylinder bore including a product input port and a product output port, both selectively fluidly connected to the cylinder bore.

As shown in FIG. 5, in a first step 101, a product flow aperture of a pallet valve is selectively positioned in a first position wherein the product flow aperture is aligned with the product input port of the cylinder housing so that a valve bore of the cylindrical pallet valve fluidly communicates with the filler product source through the product input port. In a next step 102, a piston is displaced in the valve bore of the cylindrical pallet valve, thereby drawing filler product into the valve bore from the filler product source through the product input port and the product flow aperture. In a step 103, the product flow aperture is selectively positioned in a second position wherein the product flow aperture is aligned with the product output port of the cylinder housing so that the filler product may be discharged from the valve bore through the product output port. In a final step 104, the piston is displaced into the valve bore of the cylindrical pallet valve, thereby discharging the filler product from the valve bore through the product flow aperture and the product output port.

In use, and referring again to FIGS. 2 and 4, rotary actuator 40 initiates operation by selectively positioning cylindrical segment 52, referring to FIG. 4, in a first angular position by rotation along longitudinal axis A until product intake aperture 55 is aligned with product input port 21 of cylinder housing 2 so that valve bore 51 of pallet valve 50 fluidly communicates with filler product source 11, shown in FIG. 2, through product input port 21. Referring to FIG. 4, linear actuator 30 operates to displace piston 35, thereby retracting piston 35 within valve bore 51 of pallet valve 50. As piston 35 retracts within valve bore 51, filler product FP, shown in FIG. 2, is drawn into valve bore 51 from filler product source 11, shown in FIG. 2, through product input port 21 and product intake aperture 55. Referring to FIG. 4, once piston 35 has reached a selected linear position within valve bore 51, rotary actuator 40 again initiates operation by selectively positioning cylindrical segment 52 in a second angular position by rotation along longitudinal axis A until product discharge aperture 56 aligns with product output port 22 of cylinder housing 25. Linear actuator 30 operates to displace piston 35, thereby pushing piston 35 into valve bore 51. As piston 35 extends into valve bore 51, filler product FP, shown in FIG. 2, is discharged from valve bore 51 through product output port 22 and nozzle 27.

The systems and methods described above present a number of distinct advantages over conventional automated fillers for dispensing viscous product. For example, by combining the structure and functionality of the product cylinder and the pallet valve, integrated filler 20 enjoys advantages in speed of operation over conventional systems. Additionally, certain conductive tubing is eliminated in such combination, resulting in increased speed of operation.

Advantages of the systems and methods described above may as well be found in the degree of control over operation parameters realized. More particularly, and referring to FIG. 2, in some embodiments, linear actuator 30 is controlled by linear actuator servo controller 16 and rotary actuator 40 is controlled by rotary actuator servo controller 17. Servo control of the actuators advantageously permits the ease and convenience of "on the fly" adjustment of the actuators, i.e., the actuators can be remotely adjusted during operation and the results of said adjustment may be observed in real time.

Additionally, the control device 15 permits an operator to program for a variety of flow dispensing characteristics. By way of illustration, the length of the stroke of linear actuator may be programmed for any given filler product in order to vary the amount of filler adder to any particular receptacle. Additionally, the speed of travel of the linear actuator may be varied to control the volume of flow at the nozzle. Similarly, a speed of rotation of cylindrical segment 52 and the angular position of product discharge aperture 56 may be controlled to regulate filler discharge. Additionally, various combinations of speed of linear actuator travel, speed of rotary actuator travel and configuration discharge aperture 28 of nozzle 27 may be employed to provide a wide range of selectable and programmable flow characteristics.

Therefore, according to one embodiment of the present invention, an integrated filler system to transfer a filler product from a filler product source to a product receptacle includes a cylinder housing and a pallet valve disposed within the cylinder housing, the pallet valve including a product flow aperture. The integrated filler system also includes a piston inserted in a valve bore of the pallet valve, a linear actuator connected to the piston to selectively actuate a linear travel of the piston within the valve bore. The integrated filler system further includes a rotary actuator connected to the pallet valve to selectively position the product flow aperture to fluidly communicate with one of a product input port and a product output port formed in the cylinder housing.

In accordance with another embodiment of the present invention, a servo controlled integrated filler system includes a cylinder housing having a cylinder bore therein, a product input port, and a product output port. The servo controlled integrated filler system also includes a pallet valve disposed within the cylinder bore containing at least one product flow aperture therein and a piston positioned in a valve bore of the pallet valve. The servo controlled integrated filler system further includes a first actuator connected to the piston to actuate a first movement thereof, a second actuator connected to the pallet valve to selectively position the at least one product flow aperture to align with one of the product input port and the product output port, and a servo controller system to control movement of at least one of the first actuator and the second actuator.

In accordance with yet another embodiment of the present invention, a method for transferring a filler product from a filler product source to a product receptacle includes the step of connecting an integrated filler system to a filler product source, the integrated filler system including a pallet valve disposed within a cylinder bore of a cylinder housing, and wherein the cylinder housing includes a product input port and a product output port selectively fluidly connected to the cylinder bore. The method also includes the steps of aligning a product flow aperture of the pallet valve with the product input port to place a valve bore in the pallet valve in fluid communication with the filler product source and displacing a piston to draw a filler product from the filler product source. The method further includes the steps of aligning the product flow aperture with the product output port; and displacing the piston to discharge the filler product through the product flow aperture and the product output port.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. An integrated filler system to transfer a filler product from a filler product source to a product receptacle, the integrated filler system comprising:

a cylinder housing having a cylinder bore therein, a product input port and a product output port;

a pallet valve disposed within the cylinder housing, the pallet valve including a product flow aperture;

a piston inserted in a valve bore of the pallet valve;

a linear actuator connected to the piston to selectively actuate a linear travel of the piston within the valve bore; and a rotary actuator connected to the pallet valve to selectively position the product flow aperture to fluidly communicate with one of the product input port and the product output port formed in the cylinder housing.

2. The integrated filler system of claim 1 further comprising a linear actuator servo controller to control at least one of a stroke length and a stroke speed of the linear actuator.

3. The integrated filler system of claim 2 further comprising a rotary actuator servo controller to control at least one of an angular speed and an angular displacement of the rotary actuator.

4. The integrated filler system of claim 3 further comprising a control device connected to the linear actuator servo controller and the rotary actuator servo controller to control operation thereof in real-time.

5. The integrated filler system of claim 1 wherein when the product flow aperture is in fluid communication with the product input port, a filler product is transferred from a filler product source into the valve bore.

6. The integrated filler system of claim 1 wherein when the product flow aperture is in fluid communication with the product output port, a filler product is transferred out from the valve bore.

7. The integrated filler system of claim 1 wherein the linear actuator further comprises an actuator rod configured to selectively extend and retract to move the piston.

8. The integrated filler system of claim 1 wherein the rotary actuator is one of an in-line direct drive and a 90° drive.

9. The integrated filler system of claim 1 wherein the piston further comprises at least one seal to form a leak-proof fit between the piston and the pallet valve.

10. The integrated filler system of claim 1 further comprising a driveshaft to connect the rotary actuator to the pallet valve.

11. A servo controlled integrated filler system comprising:

a cylinder housing having a cylinder bore therein, a product input port, and a product output port;

a pallet valve disposed within the cylinder bore containing at least one product flow aperture therein;

a piston positioned in a valve bore of the pallet valve;

a first actuator connected to the piston to actuate a first movement thereof;

a second actuator connected to the pallet valve to selectively position the at least one product flow aperture to align with one of the product input port and the product output port; and a servo controller system to control movement of at least one of the first actuator and the second actuator.

12. The servo controlled integrated filler system of claim 11 wherein the servo controller system further comprises a control device to programmably control and adjust operation of the servo controller system.

13. The servo controlled integrated filler system of claim 11 wherein the servo controller system further comprises a first actuator servo controller connected to the control device and the first actuator and configured to control a speed of the first actuator.

14. The servo controlled integrated filler system of claim 11 wherein the servo controller system further comprises a second actuator servo controller connected to the second actuator and configured to control a speed of the second actuator.

15. The servo controlled integrated filler system of claim 11 wherein the at least one product flow aperture further comprises an intake aperture and a discharge aperture.

16. The servo controlled integrated filler system of claim 15 wherein the intake aperture selectively fluidly communicates with the product input port and the discharge aperture selectively fluidly communicates with the product output port.

17. The servo controlled integrated filler system of claim 11 wherein the first actuator is a linear actuator having an adjustable stroke length and stroke speed and the second actuator is a rotary actuator having an adjustable angular displacement and angular speed.

18. A method for transferring a filler product from a filler product source to a product receptacle comprising the steps of:

connecting an integrated filler system to a filler product source, the integrated filler system including a pallet valve disposed within a cylinder bore of a cylinder housing a piston inserted in a valve bore of the pallet valve, wherein the cylinder housing includes a product input port and a product output port selectively fluidly connected to the cylinder bore;

aligning a product flow aperture of the pallet valve with the product input port to place a valve bore in the pallet valve in fluid communication with the filler product source;

displacing a piston to draw the filler product from the filler product source;

aligning the product flow aperture with the product output port; and displacing the piston to discharge the filler product through the product flow aperture and the product output port.

19. The method of claim 18 wherein displacing the piston further comprises moving the piston into and out from the valve bore of the pallet valve.

20. The method of claim 19 wherein displacing the piston further comprises actuating a linear actuator to linearly displace the piston within the valve bore.

21. The method of claim 18 wherein aligning the product flow aperture further comprises actuating a rotary actuator connected to the pallet valve to rotate the product flow aperture.

22. The method of claim 18 further comprising discharging the filler product from a nozzle attached to the product output port and into a product receptacle.

23. The method of claim 18 further comprising adjusting the displacing of the piston and alignment of the product flow aperture by way of a servo control system.

* * * * *